US008646389B2

(12) United States Patent
Masinelli

(10) Patent No.: US 8,646,389 B2
(45) Date of Patent: Feb. 11, 2014

(54) JACKETED BULLET WITH BONDED CORE

(75) Inventor: Kyle A. Masinelli, Staunton, IL (US)

(73) Assignee: Olin Corporation, Clayton, MO (US)

( * ) Notice: Subject to any disclaimer, the term of this patent is extended or adjusted under 35 U.S.C. 154(b) by 0 days.

(21) Appl. No.: 13/570,768

(22) Filed: Aug. 9, 2012

(65) Prior Publication Data

US 2013/0092042 A1 Apr. 18, 2013

Related U.S. Application Data

(63) Continuation of application No. 12/143,695, filed on Jun. 20, 2008, now Pat. No. 8,256,352.

(60) Provisional application No. 61/034,149, filed on Mar. 5, 2008.

(51) Int. Cl.
*F42B 12/34* (2006.01)

(52) U.S. Cl.
USPC ..... 102/514; 102/517

(58) Field of Classification Search
USPC ..... 102/507, 508, 514, 515, 516, 517; D22/116
See application file for complete search history.

(56) References Cited

U.S. PATENT DOCUMENTS

| | | | | | |
|---|---|---|---|---|---|
| 1,294,329 | A * | 2/1919 | Bowers et al. | ..... | 102/518 |
| 3,230,886 | A * | 1/1966 | Woodring | ..... | 102/507 |
| 4,550,662 | A * | 11/1985 | Burczynski | ..... | 102/509 |
| 4,610,061 | A * | 9/1986 | Halverson | ..... | 86/55 |
| 4,776,279 | A * | 10/1988 | Pejsa | ..... | 102/510 |
| 5,079,814 | A * | 1/1992 | Moore et al. | ..... | 86/55 |
| 5,101,732 | A * | 4/1992 | Schluckebier | ..... | 102/509 |
| 5,127,332 | A * | 7/1992 | Corzine et al. | ..... | 102/509 |
| 5,208,424 | A * | 5/1993 | Schluckebier et al. | ..... | 102/509 |
| 5,385,100 | A * | 1/1995 | Corzine et al. | ..... | 102/507 |
| 5,528,990 | A * | 6/1996 | Corzine et al. | ..... | 102/514 |
| 6,176,186 | B1 * | 1/2001 | Engel | ..... | 102/510 |
| 6,244,187 | B1 * | 6/2001 | Head | ..... | 102/516 |
| 6,439,124 | B1 * | 8/2002 | Enlow et al. | ..... | 102/501 |
| 6,523,477 | B1 * | 2/2003 | Brooks et al. | ..... | 102/481 |
| 6,530,328 | B2 * | 3/2003 | Burczynski et al. | ..... | 102/507 |
| 6,629,485 | B2 * | 10/2003 | Vaughn et al. | ..... | 86/55 |
| 6,732,657 | B2 * | 5/2004 | Olin | ..... | 102/507 |
| 6,805,057 | B2 * | 10/2004 | Carr et al. | ..... | 102/509 |
| 7,150,233 | B1 * | 12/2006 | Eberhart | ..... | 102/516 |
| 2005/0126422 | A1 * | 6/2005 | Lamm | ..... | 102/518 |
| 2010/0018430 | A1 * | 1/2010 | Masinelli et al. | ..... | 102/507 |

* cited by examiner

*Primary Examiner* — Benjamin P Lee
(74) *Attorney, Agent, or Firm* — Harness, Dickey & Pierce, P.L.C.

(57) ABSTRACT

A jacketed bullet comprising a dense core of a first material substantially surrounded by and bonded to a jacket of a second material, wherein the thickness of the jacket varies.

16 Claims, 10 Drawing Sheets

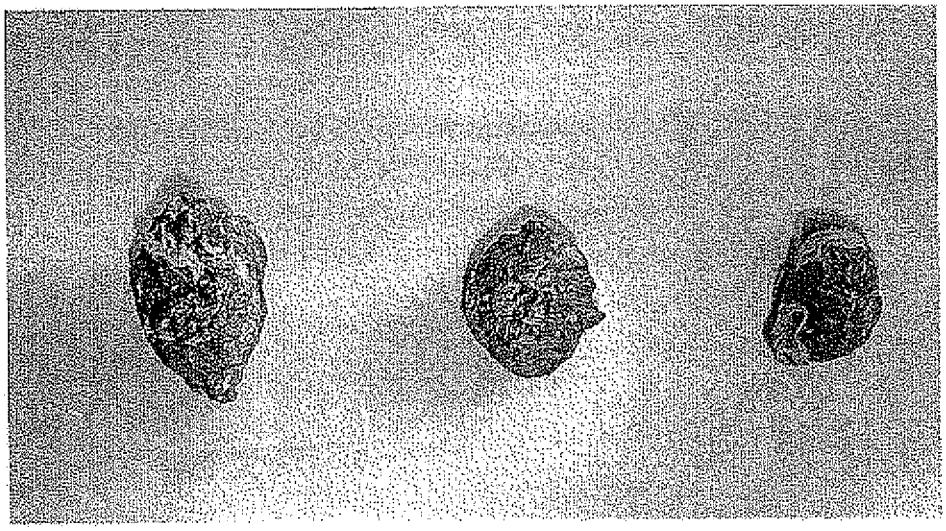
Fig. 10A
Fig. 10B
(Prior Art)
Fig. 10C
(Prior Art)
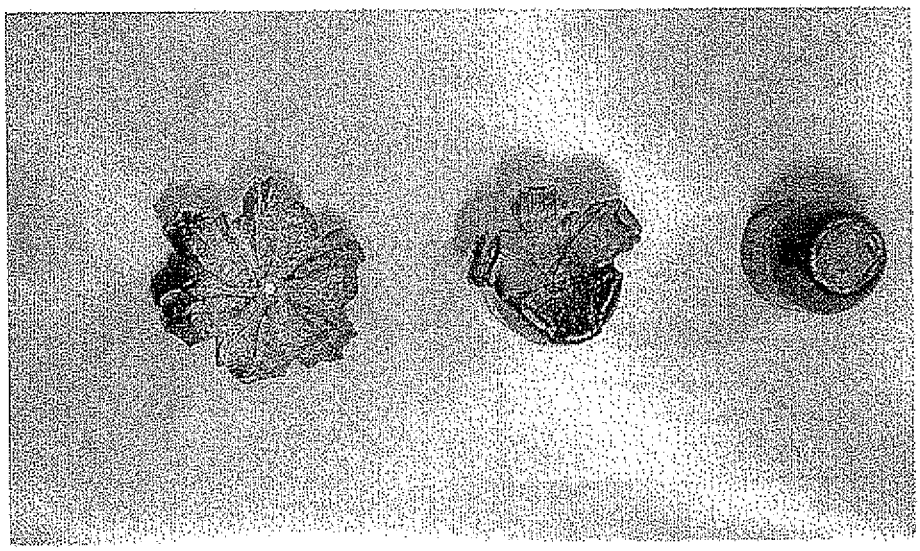
Fig. 11A
Fig. 11B
(Prior Art)
Fig. 11C
(Prior Art)

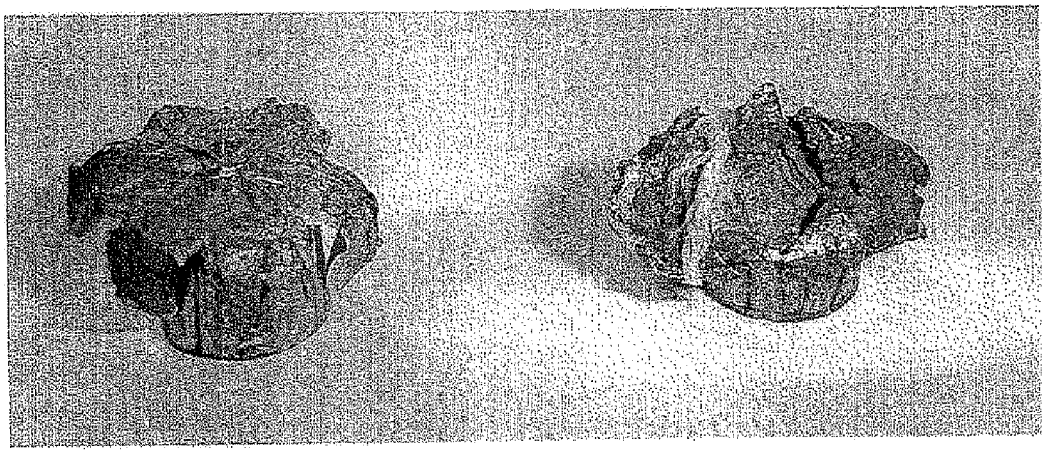
Fig. 12A
Fig. 12B
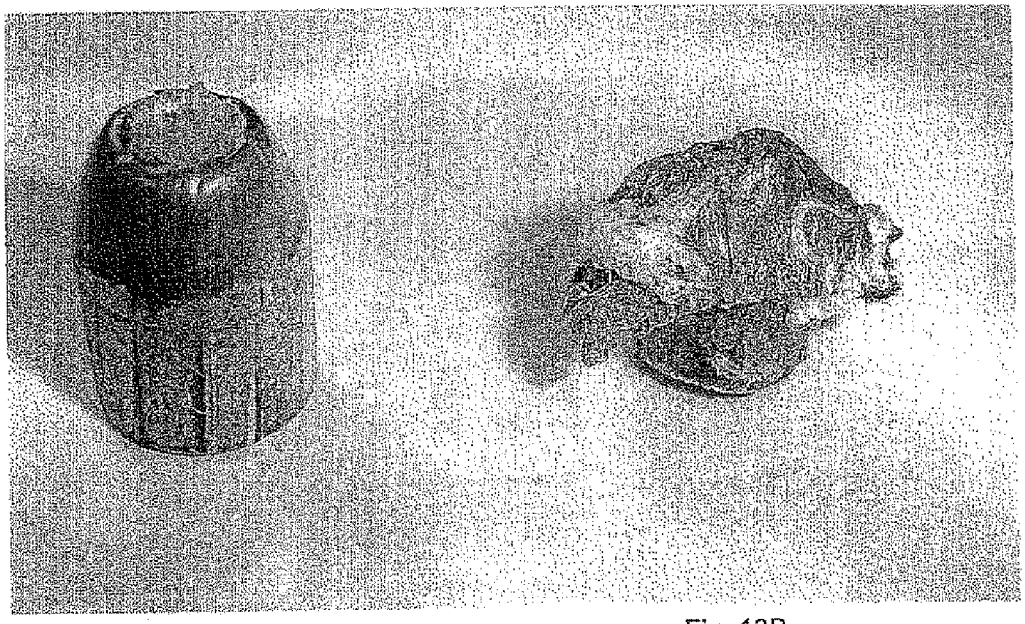
Fig. 13A
(Prior Art)
Fig. 13B
(Prior Art)

JACKETED BULLET WITH BONDED CORE

CROSS-REFERENCE TO RELATED APPLICATIONS

This application is a continuation of U.S. patent application Ser. No. 12/143,695, filed Jun. 20, 2008, which is now U.S. Pat. No. 8,256,352, issued Sep. 4, 2012, which claims the benefit of U.S. Provisional Patent Application Ser. No. 61/034,149, filed Mar. 5, 2008, the entire disclosures of both of which are incorporated herein by reference.

BACKGROUND

This invention relates generally to bullets, and more particularly to small caliber bullets having a metal jacket and a hollow point.

Bullets are jacketed to improve the ability of the bullet to penetrate barriers and remain intact. Most commonly the jacket (typically copper) is plated onto the core (typically lead). This results in a thin, uniform jacket that provides more structural integrity to the bullet and improves penetration in at least some circumstances.

Another type of jacketed bullet is made by forming a cup-shaped jacket perform (typically copper) and inserting a preformed core (typically lead) into the jacket perform, bonding the core to the jacket, and forming the open front end of the jacket into the front end of the bullet, so that the thickness of the jacket increases toward the back of the bullet.

Another type of jacketed bullet is made by forming a cup-shaped jacket preform (typically copper) and inserting a preformed core (typically lead) into the jacket preform and swaging the core and jacket together, and forming the closed end of the bullet into the front of the bullet. This type of jacketed bullet is more completely described in co-assigned U.S. Pat. No. 5,208,424, the entire disclosure of which is incorporated by reference. While the thickness of the jacket of this bullet tapers toward the rear, the core is merely mechanically held in the jacket.

One measure of bullet performance is the Federal Bureau of Investigation Ammunition Test Protocol. This Protocol is a series of tests that measure a bullet's ability to defeat different types of barriers, penetrate the target, and retain mass and expand to cause maximum damage to the target. The Protocol assesses a bullet's ability to inflict effective wounds after defeating various intervening obstacles commonly present in law enforcement shootings. The overall results of a test are thus indicative of that specific cartridge's suitability for the wide range of conditions in which law enforcement officers engage in shootings.

According to the FBI Ammunition Test Protocol, bullets are fired into 6×6×16 inch blocks of 10% Ballistic Gelatin (Kind & Knox 250-A) at 4° C. (39.2° F.) five times in eight separate events. Each shot's penetration is measured to the nearest 0.25 inch. The bullet is recovered, weighed, and measured for expansion by averaging its greatest diameter with its smallest diameter. The test events are:

Test Event 1: Bare Gelatin The gelatin block is bare, and shot at a range of ten feet measured from the muzzle to the front of the block.

Test Event 2: Heavy Clothing The gelatin block is covered with four layers of clothing: one layer of cotton T-shirt material (48 threads per inch); one layer of cotton shirt material (80 threads per inch); a one layer of Malden Mills Polartec 200 fleece; and one layer of 14.4. ounces per yard cotton denim (50 threads per inch). The block is shot at ten feet, measured from the muzzle to the front of the block.

Test Event 3: Steel Two pieces of 20 gauge, hot rolled steel with a galvanized finish are set three inches apart. The gelatin block is covered with Light Clothing and placed 18 inches behind the rear most piece of steel. The shot is made at a distance of 10 feet measured from the muzzle to the front of the first piece of steel. Light Clothing is one layer of the above described T-shirt material and one layer of the above described cotton shirt material.

Test Event 4: Wallboard Two pieces of half-inch standard gypsum board are set 3.5 inches apart. The pieces are six inches square. The gelatin block is covered with Light Clothing (as described in Test Event 3) and placed 18 inches behind the rear most piece of gypsum. The shot is made at a distance of ten feet, measured from the muzzle to the front of the first piece of gypsum.

Test Event 5: Plywood One piece of three-quarter inch AA fir plywood is used. The piece is six inches square. The gelatin block is covered with Light Clothing (as described in Test Event 3) and placed 18 inches behind the rear surface of the plywood. The shot is made at a distance of ten feet, measured from the muzzle to the front surface of the plywood.

Test Event 6: Automobile Glass One piece of A.S.I. one-quarter inch laminated automobile safety glass measuring 15×18 inches is set at an angle of 45° to the horizontal. The line of bore of the weapon is offset 15° to the side, resulting in a compound angle of impact for the bullet upon the glass. The gelatin block is covered with Light Clothing (as described in Test Event 3) and placed 18 inches behind the glass. The shot is made at a distance of ten feet, measured from the muzzle to the center of the glass pane.

Test Event 7: Heavy Clothing at 20 yards. This event repeats Test Event 2 but at a range of 20 yards, measured from the muzzle to the front of the gelatin.

Test Event 8: Automobile Glass at 20 yards. This event repeats Test Event 6 but at a range of 20 yards, measured from the muzzle to the front of the glass, and without the 15° offset.

A composite score of the 40 shots is then established, with the maximum score being 500. A higher score generally indicates a more consistent performing bullet under wide ranging conditions. The parameter that has the highest impact on overall score is the standard deviation of penetration amongst all 40 shots. If even a single shot fails to upset, it will subsequently over penetrate and increase the measured standard deviation thus resulting in a lower score. Existing jacketed bullets generally perform satisfactorily on the FBI Ammunition Test Protocol, with scores ranging from 275 to 375 for plated jacketed bullets, and from 200 to 325 for bullets made with jacket preforms. While functional, there was clearly room for improvement, at least as measured by the FBI Ammunition Test Protocol.

SUMMARY

This invention relates generally to improvements in small caliber bullets having a metal jacket and a hollow point. According to one embodiment, the jacketed bullet comprises a dense core of a first material substantially surrounded by and bonded to a jacket of a second material. The thickness of the jacket varies, preferably decreasing from the front end of the bullet toward the back end of the bullet.

In one preferred embodiment the bullet has an aft section with a generally cylindrical sidewall, a forward section with a tapering sidewall generally tapering toward the front end of the bullet, and a recess in the front end. The jacket is preferably thicker at the front end of the bullet than at the back end of the bullet. More preferably, the thickness of the jacket decreases from the juncture between the aft and forward sections, toward the back end of the bullet. The jacket may extend at least partly into the recess in the front of the bullet. Some embodiments of the bullets may include a plurality of longitudinally extending lines of weakness in the forward section of the bullet to facilitate the formation of petals after the bullet strikes an object. The lines of weakness can be linear areas of reduced thickness in the jacket, or slits through the jacket. These lines of weakness are preferably substantially equally spaced around the circumference of the bullet so that the bullet forms petals of substantially equal size upon expansion after impact.

Some embodiments of the bullets have an opening in the back, exposing the core. While in other embodiments this opening is closed, for example with an insert between the jacket and the core, covering the opening.

In the various embodiments the core is more than swaged or mechanically molded to the jacket with pressure, and is bonded to the jacket. The preferred bonding process is soldering in which a preformed core is inserted into the jacket and heated so that the core bonds to the jacket. Flux can be introduced into the jacket to facilitate bonding of the core to the jacket. Other methods of bonding can also be used, including for example the use of adhesives.

The various embodiments of the present invention provide a jacketed bullet in which the core is bonded to the jacket and the thickness of the jacket varies. This general configuration allows the bullets to be designed to defeat many different types of barriers, and to provide good and consistent penetration. These and other features and advantages will be in part apparent and in part pointed out hereinafter.

BRIEF DESCRIPTION OF THE DRAWINGS

FIG. 5A is a longitudinal cross sectional view of the jacket preform;

FIG. 5B is a longitudinal cross sectional view of the core shown bonded to the jacket preform;

FIG. 5C is a longitudinal cross sectional view of the bonded jacket and core inverted prior to notching;

FIG. 5D is a longitudinal cross sectional view of the bonded jacket and core after notching to form the recess in the nose and the lines of weakness;

FIG. 5E is a longitudinal cross sectional view of the bullet after shaping of the nose and back of the bullet;

FIG. 5F is a longitudinal cross sectional view of the bullet after shaping of the nose and back of the bullet, similar to FIG. 5E, but showing an insert for complete closing the back of the bullet;

FIG. 6A is a longitudinal cross sectional view of the jacket preform;

FIG. 6B is a longitudinal cross sectional view of the core shown bonded to the jacket preform;

FIG. 6C is a longitudinal cross sectional view of the bonded jacket and core after notching to form the recess in the nose and the lines of weakness;

FIG. 6D is a perspective view of the bonded jacket and core after notching to form the recess in the nose and the lines of weakness;

FIG. 10A is a photographic top elevation view of a bullet constructed according to the principles of this invention, recovered after Test Event 6 (auto glass);

FIG. 10B is a photographic top elevation view of a prior art plated jacketed bullet recovered after Test Event 6 (auto glass);

FIG. 10C is a photographic top elevation view of a prior art non-reverse tapered jacketed bullet recovered after Test Event 6 (auto glass);

FIG. 11A is a photographic top elevation view of a bullet constructed according to the principles of this invention, recovered after Test Event 5 (plywood);

FIG. 11B is a photographic top elevation view of a prior art plated jacketed bullet recovered after Test Event 5 (plywood);

FIG. 11C is a photographic top elevation view of a prior art non-reverse tapered jacketed bullet recovered after Test Event 5 (plywood);

FIG. 12A is a photographic perspective view of a bullet constructed according to the principles of this invention, recovered after Test Event 5 (plywood);

FIG. 12B is a photographic perspective view of a prior art non-reverse tapered jacketed bullet, recovered after Test Event 6 (auto glass);

FIG. 13A is a photographic perspective view of a prior art non-reverse tapered jacketed bullet, recovered after Test Event 5 (plywood);

FIG. 13B is a photographic perspective view of a bullet constructed according to the principles of this invention, recovered after Test Event 6 (auto glass)

Corresponding reference numerals indicate corresponding parts throughout the several views of the drawings. The drawings described herein are for illustration purposes only and are not intended to limit the scope of the present disclosure in any way.

DETAILED DESCRIPTION

Figure 1:
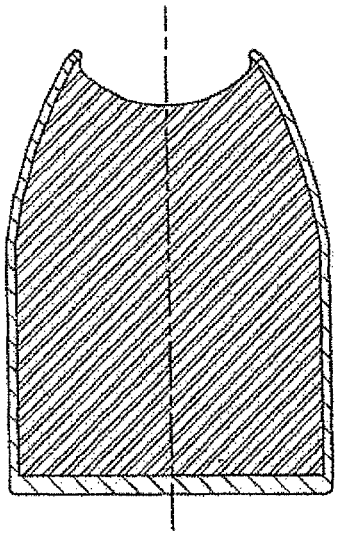
Fig. 1 (Prior Art)
FIG. 1 is a longitudinal cross-sectional view of a prior art jacketed bullet in which front end of the bullet is formed from the open end of the jacket, and thus the jacket increases in thickness toward the back of the bullet.
Figure 2:
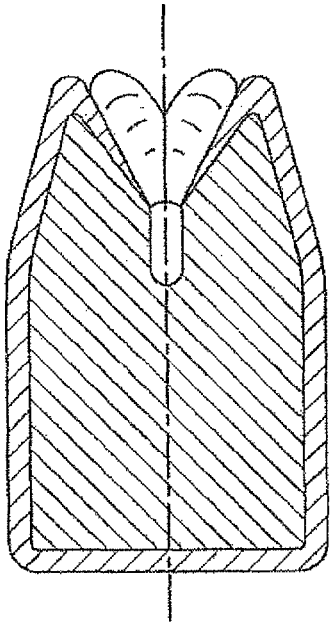
Fig. 2 Prior Art
FIG. 2 is a longitudinal cross-sectional view of a preformed type prior art jacketed bullet.

The following description is merely exemplary in nature and is not intended to limit the present disclosure, application, or uses. Generally, prior art jacketed bullets either had a thin, uniform plated jacket (as shown generally in FIG. 1), or a thicker preformed jacket in which the core is mechanically attached (as shown generally in FIG. 2). In contrast to the prior art, preferred embodiments of the present invention provide a jacketed bullet comprising a dense core of a first material substantially surrounded by and bonded to a jacket of a second material, in which the thickness of the jacket varies. Preferably, at least some portions of the jacket adjacent the front of the bullet are thicker than at least some portions of the jacket adjacent the back end of the bullet. More preferably the thickness of the jacket decreases from the front end of the bullet toward the back end of the bullet.

Figure 3:
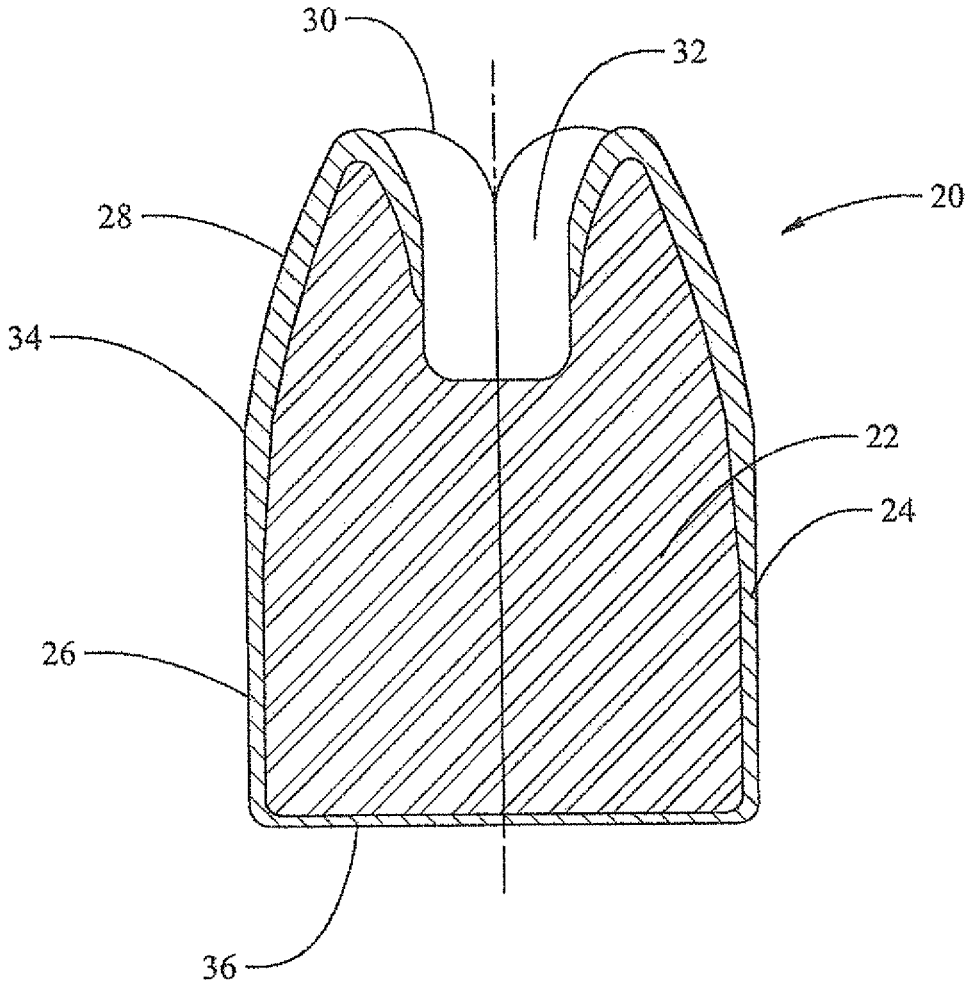
FIG. 3 is a longitudinal cross-sectional view of one preferred embodiment of a jacketed, bonded bullet according to the principles of this invention.
Figure 4:
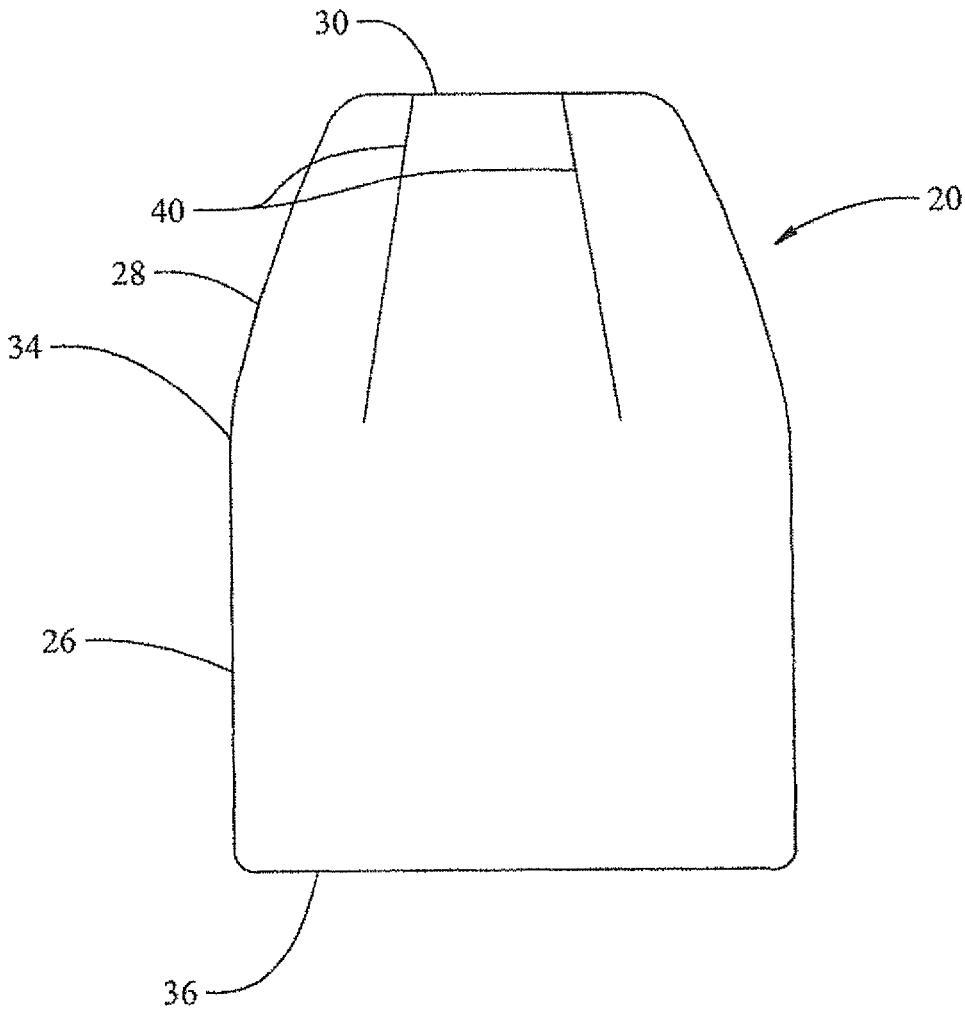
FIG. 4 is a side elevation view of the preferred embodiment of a jacketed, bonded bullet according to the principles of this invention.
Figure 5A:
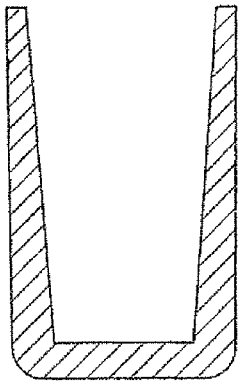
FIG. 5A-5F are schematic longitudinal cross sectional views illustrating a preferred embodiment of steps of manufacturing a jacketed, bonded bullet according to the principles of this invention.
Figure 5B:
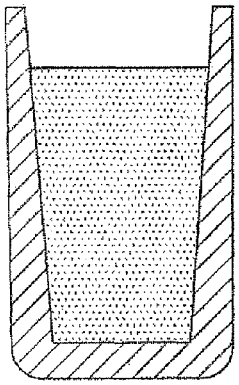
Figure 5C:
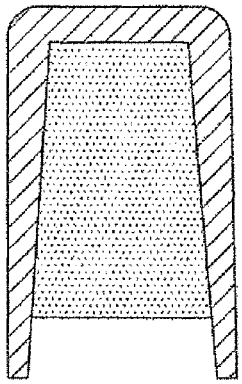
Figure 5D:
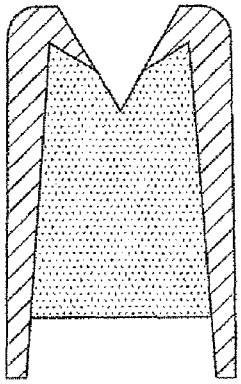
Figure 5E:
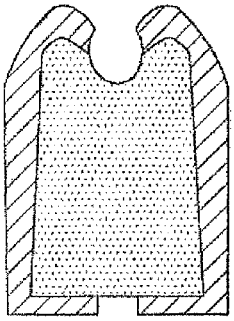
Figure 5F:
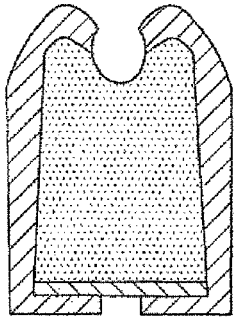
Figure 6A:
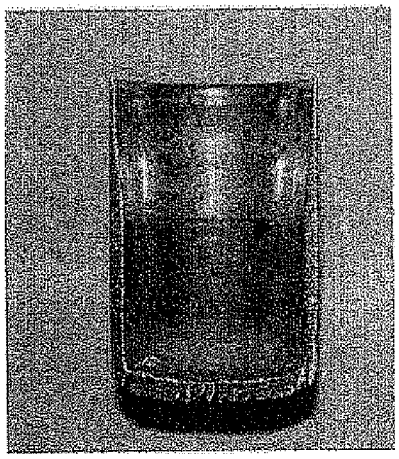
FIG. 6A-6D are photographic longitudinal cross sections illustrating the various steps of manufacturing a jacketed, bonded bullet according to the principles of this invention.
Figure 6B:
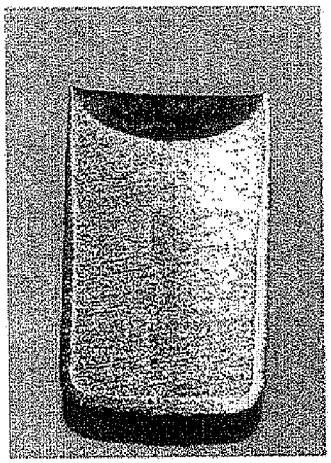
Figure 6C:
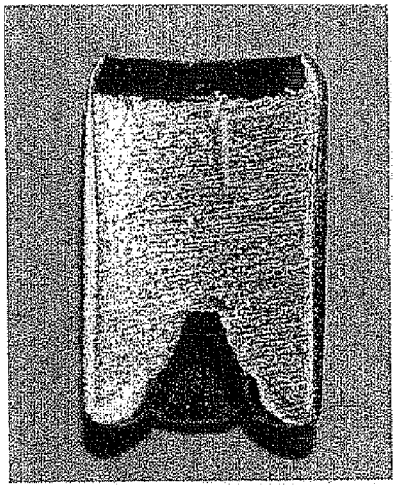
Figure 6D:
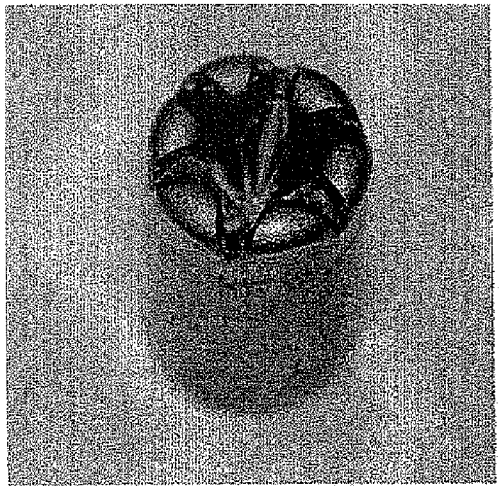
Figure 7:
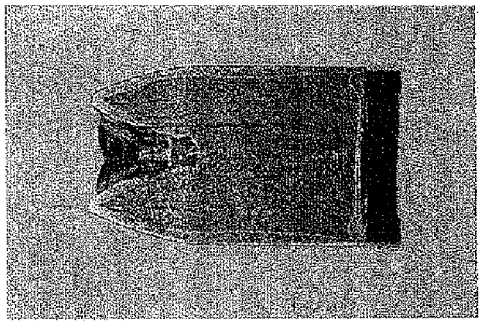
FIG. 7 is a photographic longitudinal cross section of a bullet accordance with the principles of this invention.
Figure 8A:
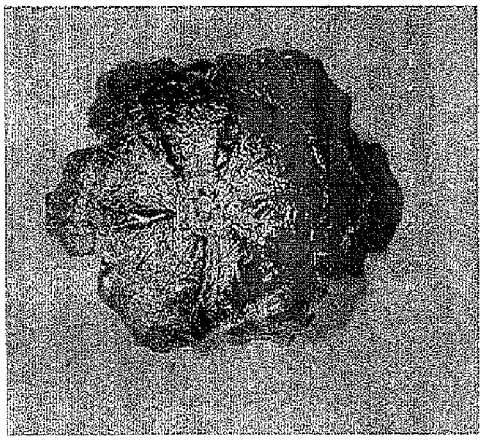
FIG. 8A is a photographic top plan view of an upset of a bullet in accordance with the principles of this invention, recovered after Test Event 2 (heavy clothing)
Figure 8B:
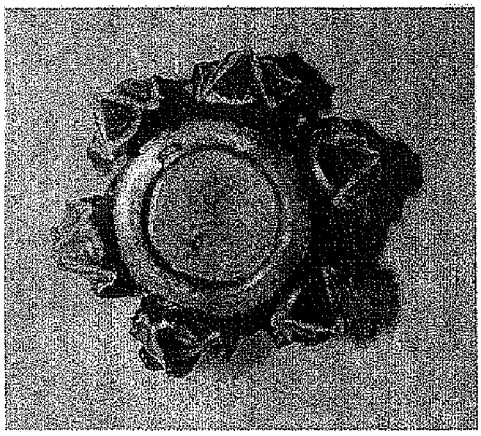
FIG. 8B is a photographic bottom plan view of the upset of FIG. 8A.
Figure 8C:
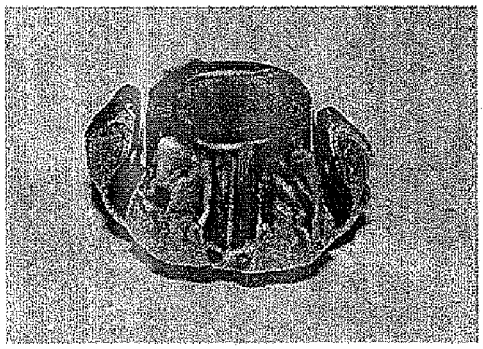
FIG. 8C is a photographic rear perspective view of the upset of FIG. 8A.

A preferred embodiment of a bullet constructed according to the principles of the present invention is indicated generally as 20 in FIG. 3. The bullet 20 comprises a core 22 bonded to a jacket 24. The bullet 20 has an aft section 26 with a generally cylindrical profile, and a forward section 28 with a tapered profile generally tapering toward the front end 30 of the bullet. There is preferably a recess 32 in the front end 30 of the bullet 20. As shown in FIG. 3, the thickness of the jacket decreases from near the juncture 34 between the aft and forward sections 26 and 28 toward the back end 36 of the bullet. However, the precise location of the decrease in thickness may vary from design to design. It is generally desirable that the thickness of the jacket is greater at the front end 30 of the bullet, than adjacent the back end 36 of the bullet. The thickness of the jacket may vary continuously, or the thickness may vary in a stepwise, or other some manner.

The core 22 is preferably made of a dense, malleable material, such as lead or a lead alloy. The core 22 could also be made of a non-lead metal, such as bismuth, bismuth alloys, tungsten, tungsten alloys, tin or tin alloys, or any other dense, malleable, metal that can be bonded to the jacket. The jacket 24 is preferably made from a stronger material, such as copper, a copper alloy, or steel, or any other suitable metal. The core 22 and the jacket 24 can be bonded by melting or soldering. As described in more detail below, according to the preferred method of making the bullet, a preformed core in placed in a preformed jacket, and the core and jacket are heated form a metallurgical bond between the jacket and the core, preferably to a temperature high enough to completely convert the core material to a molten state, (about 700° F. in this preferred embodiment in which the core is made of lead or lead alloy). Flux can be used to facilitate bonding. Alternatively, an adhesive could be used to bond the core 22 and the jacket 24. Examples of suitable adhesives include epoxy, glue, or any other type of contact adhesive. Other methods of bonding the core and the jacket can also be used provided that they achieve a true bond between the material of the jacket and the material of the core, and not just a mechanical connection.

The jacket 24 is not of uniform thickness, and is preferably thicker adjacent the front end 30 of the bullet than adjacent the back end 36. In the preferred embodiment, the jacket 24 is between about 0.018 and about 0.030 inches thick adjacent the front end 30 of the bullet, and between about 0.006 and about 0.020 inches thick adjacent the back end 36 of the back end of the bullet. The greater thickness of the jacket 24 adjacent the front end 30 of the bullet, combined with the bonding of the core and the jacket allows the front end of the bullet to resist crushing while penetrating deeper. The lesser thickness of the jacket 24 adjacent the rear of the bullet allows the cylindrical portion of the bullet to further engage the rifling of the barrel resulting in improved accuracy over thicker jacket bullets. The jacket 24 can be open at the back end 36 of the bullet, exposing the core. Alternatively, the core can be completely enclosed. A disk-shaped insert 38 can be positioned over the core, and the jacket crimped around the insert to enclose the core. The jacket 24 preferably extends at least partly into the recess 32 in the front 30 of the bullet 20, and preferably extends only partly into the recess. The thickness of the jacket in the recess generally decreases from the front 30 of the bullet to the edge 38 of the jacket.

There are preferably a plurality of longitudinally extending lines of weakness 40 in the forward section 28 of the bullet 20 to facilitate the formation of petals after the bullet expands upon striking an object. These lines of weakness 40 preferably comprise linear area of reduced thickness in the jacket or slits extending through the jacket and possibly at least partially into the core. These lines of weakness are preferably substantially equally spaced around the circumference of the bullet so that the bullet forms petals of substantially equal size upon expansion. However the lines of weakness could be placed so that the petals are not equal in size. In certain applications unequal petal size could be advantageous. In the preferred embodiment there are six lines of weakness 40, which form six petals, but there could be fewer or more lines of weakness if desired.

In accordance with another aspect of this invention, a method of making bullets having a metal jacket with a hollow point is provided. Generally, the method comprises forming a bonded core 22 inside a preformed cup-shaped jacket 24 having with a first closed end 42 and a sidewall 44 whose thickness generally decreases from the first closed end toward a second open end 46. An opening 48 is formed through the first closed end 42 of the jacket 24 and into the core 22. Lines of weakness 40 in the jacket 24 adjacent the opening 48 formed in the first closed end. The first closed end is formed into an ogival profile to form a tapered forward section 28 and front end 26 of the bullet, with the recess 32 therein.

The back end 36 of the bullet 20 can be formed by wrapping the jacket adjacent the open end over the core, leaving an opening in the jacket through which the core is exposed. Alternatively the jacket can be closed by inserting a disk 38 into the open end of the jacket, and wrapping the jacket adjacent the open end over the disk, forming a closure which covers the core 22.

The step of forming the bonded core inside the cup-shaped jacket can comprise inserting a preformed core 22 into a preformed cup shaped jacket preform 24, and heating the core and jacket preform to form a bond between the core and jacket. Flux can be inserted into the jacket or applied to the core before heating the jacket and the core, to facilitate bonding. Alternatively, the step of forming the bonded core inside the cup-shaped jacket preform can comprise inserting a preformed core into a preformed jacket, and adhesively bonding the jacket and the core. In still another alternative, the step of forming the bonded core comprises introducing molten core material into the jacket and allowing the core material to cool under conditions that cause the core to bond with the jacket.

The step of forming the opening through the first closed end of the jacket and into the bonded core and the lines of weakness in the jacket adjacent the opening can comprise punching the first closed end of the jacket to simultaneously form the recess and the lines of weakness.

The step of forming the first closed end into an ogival profile comprises forcing the jacket and core into a die. The back end 38 of the bullet can be formed at the same time, either forming the jacket around the core to form an open back end, or inserting a disk-shaped insert into the open end of the jacket and forming the jacket around the core and insert to form a closed back end.

Figures 9A, 9B:
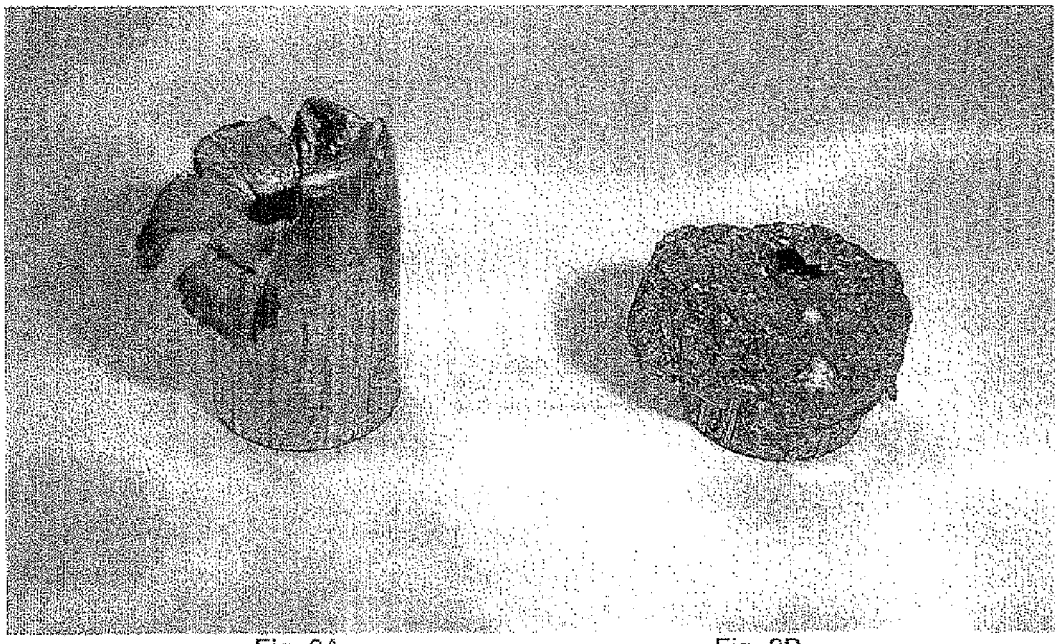
Fig. 9A (Prior Art)
Fig. 9B (Prior Art)
FIG. 9A is photographic perspective view of a prior art plated jacketed bullet recovered after Test Event 5 (plywood)
FIG. 9B is a photographic perspective view of a prior art plated jacketed bullet recovered after Test Event 6 (auto glass)
Figure 14:
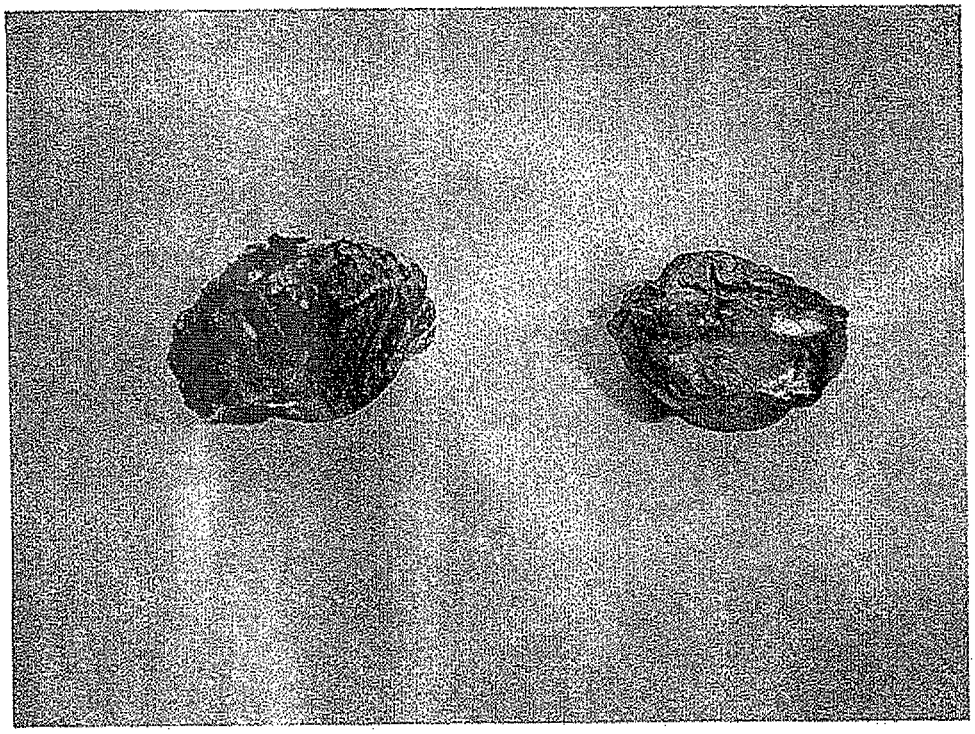
FIG. 14 is a photographic plan view of an embodiment of a bullet according to the principles of this invention (left) and a prior art mechanically bonded bullet (right) after Test Event 6 (auto glass).

FIG. 9A is photographic perspective view of a prior art plated jacketed bullet recovered after Test Event 5 (plywood), and FIG. 9B is a photographic perspective view of a prior art plated jacketed bullet recovered after Test Event 6 (auto glass), showing the inability of a prior art plated jacketed bullet to defeat common barriers, and properly expand.

FIG. 10A is a photographic top elevation view of a bullet constructed according to the principles of this invention, recovered after Test Event 6 (auto glass). FIG. 10B is a photographic top elevation view of a prior art plated jacketed bullet recovered after Test Event 6 (auto glass). FIG. 10C is a photographic top elevation view of a prior art non-reverse tapered jacketed bullet recovered after Test Event 6 (auto glass). FIG. 10 shows that bullets constructed in accordance with the principles of this invention provide superior expansion and mass retention compared to prior art bullets.

FIG. 11A is a photographic top elevation view of a bullet constructed according to the principles of this invention, recovered after Test Event 5 (plywood). FIG. 11B is a photographic top elevation view of a prior art plated jacketed bullet recovered after Test Event 5 (plywood). FIG. 11C is a photographic top elevation view of a prior art non-reverse tapered jacketed bullet recovered after Test Event 5 (plywood). FIG. 11 shows that bullets constructed in accordance with the principles of this invention provide superior expansion and mass retention compared to prior art bullets.

FIG. 12A is a photographic perspective view of a bullet constructed according to the principles of this invention, recovered after Test Event 5 (plywood). FIG. 12B is a photographic perspective view of a prior art non-reverse tapered jacketed bullet, recovered after Test Event 6 (auto glass). FIG. 13A is a photographic perspective view of a prior art non-reverse tapered jacketed bullet, recovered after Test Event 5 (plywood). FIG. 13B is a photographic perspective view of a bullet constructed according to the principles of this invention, recovered after Test Event 6 (auto glass). Comparing FIGS. 12A and 12B with 13A and 13B, shows that bullets constructed in accordance with the principles of this invention provide superior expansion and mass retention compared to prior art bullets.

A comparison between one embodiment of a bullet constructed in accordance with the principles of this invention, and embodiments of two prior art bullets is shown in Table 1. Bullet 1 in the testing shown in the Table is a Winchester 40 S&W 165 gr T-series—Reverse Tapered Jacket, in which the core is not chemically bonded to the jacket. Bullet 2 in the testing shown in the Table is a Winchester 40 S&W 165 gr Bonded JHP in which the core is bonded in a conventional jacket, i.e. a plated bullet. Bullet 3 is an embodiment of a bullet constructed according to the principles of this invention, with a core that is chemically bonded in a reverse taper jacket. While Bullets 1 and 2 in the tests had good scores under the FBI protocol, Bullet 3 was surprisingly superior to the prior art bullets 1 and 2, earning in the testing a composite score of 374.5 nearly 100 points above Bullet 1 and nearly 170 above Bullet 2.

FBI Protocol Barrier Testing:

| Bullet | | Bare Gelatin | Heavy Cloth | Wallboard | Plywood | Steel | Auto Glass |
|---|---|---|---|---|---|---|---|
| 1. Winchester 40 S&W | Penetration | 13.2 | 14.2 | 11.4 | 13.0 | 21.3 | 12.0 |
| 165 gr T-series - Reverse | Expansion | .799 | .828 | .814 | .825 | .451 | .600 |
| Tapered Jacket | Rt. Wt. % | 99% | 99% | 99% | 99% | 100% | 56.8% |
| Test #20017 & 20033 | Rt. Wt. (gr) | 163.3 | 164.5 | 164.8 | 164.7 | 165.0 | 93.8 |
| 2. Winchester 40 S&W | Penetration | 13.9 | 16.0 | 19.9 | 25.5 | 16.5 | 12.2 |
| 165 gr Bonded JHP | Expansion | .625 | .557 | .428 | .400 | .534 | .519 |
| Test #18283 | Rt. Wt. % | 100% | 100% | 100% | 100% | 100% | 80.2% |
| | Rt. Wt. (gr) | 165.0 | 165.0 | 165.0 | 165.0 | 165.0 | 132.33 |
| 3. Winchester 40 S&W | Penetration | 13.8 | 14.0 | 12.5 | 14.3 | 17.6 | 11.1 |
| 165 gr Bonded | Expansion | .613 | .688 | .701 | .693 | .514 | .600 |
| Test #19323 | Rt. Wt. % | 100% | 100% | 100% | 100% | 100% | 85.51% |
| | Rt. Wt. (gr) | 165.0 | 165.0 | 165.0 | 165.0 | 165.0 | 141.1 |

| Bullet | Penetration Avg. (in) | Penetration Std. Deviation (in) | Expansion Avg. (in) | Retained Wt. (%) | Shots <12" | Total score out of 500 points |
|---|---|---|---|---|---|---|
| 1. Winchester 40 S&W 165 gr T-series | 14.250 | 3.792 | .720 | 92.133 | 3 | 275.5 |
| 2. Winchester 40 S&W 165 gr Bonded JHP | 17.304 | 4.767 | .510 | 96.677 | 2 | 207.5 |
| 3. Winchester 40 S&W 165 gr Bonded | 13.867 | 2.151 | .635 | 97.585 | 2 | 374.5 |

Penetration and expansion are measured in inches

The invention is not limited to the above-described embodiments. Various modifications and variations may be made within the spirit and scope of the invention. Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A jacketed bullet having an aft section with a generally cylindrical sidewall, a forward section with a tapering sidewall generally tapering toward the front end of the bullet, and recess in the front end, the jacketed bullet comprising a core of a dense first material, and a jacket of a second material bonded to the core, the jacket comprising a forward section substantially surrounding the forward section of the core, and extending at least partially into the recess in the front end, and an aft section substantially surrounding the aft section of the core, wherein the entire forward section of the jacket is thicker than the aft section of the jacket.

2. The jacketed bullet according to claim 1 wherein, the thickness of the jacket decreases from the junction between aft and forward sections of the bullet toward the back end of the bullet.

3. The jacketed bullet according to claim 1 further comprising a plurality of longitudinally extending lines of weakness in the forward section of the bullet to facilitate the formation of petals when the bullet strikes an object.

4. The jacketed bullet according to claim 3 wherein the lines of weakness comprise linear areas of reduced thickness in the jacket.

5. The jacketed bullet according to claim 3 wherein the lines of weakness comprise slits through the jacket and at least partially into the core.

6. The jacketed bullet according to claim 5 wherein the jacket extends only partially into the recess in the front of the jacket, and the thickness of the jacket in the recess generally decreases from the front of the bullet to the edge of the jacket.

7. The jacketed bullet according to claim 6 wherein the slits are substantially equally spaced around the circumference of the bullet so that the bullet forms petals of substantially equal size.

8. The jacketed bullet according to claim 1 wherein the jacket has an opening therein at the back end of the bullet.

9. The jacketed bullet according to claim 8 further comprising an insert between the jacket and the core, covering the opening.

10. A jacketed bullet having an aft section with a generally cylindrical sidewall, a forward section with a tapering sidewall generally tapering toward the front end of the bullet, and a recessed tip at the front end, the jacketed bullet comprising a core of a dense first material, and a jacket of a second material substantially surrounding the aft and forward sections of the core, and extending at least partially into the recessed tip, the thickness of the jacket over the entire forward section of the core being greater than the thickness of the jacket over the aft section, and decreasing from the junction between the forward and aft sections toward the back end of the bullet, and a plurality of longitudinally extending lines of weakness to facilitate the formation of petals when the bullet strikes an object.

11. The jacketed bullet according to claim 10 wherein the lines of weakness comprise linear areas of reduced thickness in the jacket.

12. The jacketed bullet according to claim 10 wherein the lines of weakness comprise slits through the jacket and at least partially into the core.

13. The jacketed bullet according to claim 12 wherein the slits are substantially equally spaced around the circumference of the bullet so that the bullet forms petals of substantially equal size.

14. The jacketed bullet according to claim 10 wherein the jacket extends only partially into the recess in the front of the bullet, and the thickness of the jacket in the recess generally decreases from the front of the bullet to the edge of the jacket.

15. The jacketed bullet according to claim 10 wherein the jacket has an opening therein at the back end of the bullet.

16. The jacketed bullet according to claim 10 further comprising an insert between the jacket and the core, covering the opening.

* * * * *